United States Patent [19]

Hansen

[11] 4,078,730

[45] Mar. 14, 1978

[54] TUBE MILL

[75] Inventor: Ib Hansen, Copenhagen Valby, Denmark

[73] Assignee: F. L. Smidth & Co., Cresskill, N.J.

[21] Appl. No.: 742,563

[22] Filed: Nov. 17, 1976

[30] Foreign Application Priority Data

Nov. 20, 1975 United Kingdom ..... 47842/75

[51] Int. Cl.[2] ..... B02C 23/16

[52] U.S. Cl. ..... 241/54; 241/70; 241/78

[58] Field of Search ..... 241/44, 49, 54, 57, 241/70, 71, 72, 75, 78

[56] References Cited

U.S. PATENT DOCUMENTS

| | | | |
|---|---|---|---|
| 1,719,164 | 7/1929 | Bernhard | 241/70 |
| 2,398,989 | 4/1946 | Agthe | 241/54 |
| 2,399,051 | 4/1946 | Maxson et al. | 241/71 |
| 3,459,380 | 8/1969 | Kartman | 241/72 |
| 3,537,658 | 11/1970 | Jurgenjanich | 241/54 |

*Primary Examiner*—Granville Y. Custer, Jr.
*Attorney, Agent, or Firm*—Pennie & Edmonds

[57] ABSTRACT

A tube mill is disclosed for grinding and drying granular material which comprises an elongated shell having one or more grinding chambers, and downstream of the first chamber, a dispersing compartment for receiving hot gases and material and bounded by a sieving diaphragm defining a central opening therethrough. A frustoconical sieve drum is attached to the sieving diaphragm for rotation therewith and forms a portion of an end wall of the discharge compartment.

9 Claims, 4 Drawing Figures

TUBE MILL

BACKGROUND OF THE INVENTION

1. Field of the Invention

This invention relates to tube mills of the multicompartment type for drying and grinding granular material such as cement clinker.

2. Description of the Prior Art

Multi-compartment mills for drying and grinding moist material such as cement clinker have been known to include a separate drying chamber at the inlet for introducing moist material and drying gas. The hot drying gas is usually waste gas from a burning process or it may be air heated for the particular purpose of drying the moist material. The separate drying chamber is usually equipped with lifters or stirrers which improve the drying process. The lifters or stirrers disintegrate and lift the moist material into the hot gas to obtain an intimate mixing and heat exchange therein. Further, it is known in the art to include a modest charge of grinding media in the drying chamber to grind the moist material and thereby increase the surface area for an improved heat exchange.

Such prior art tube mills are generally arranged for a straight (once through) drying and grinding process or for a circuit (material returns to the tube mill) drying and grinding process. In the latter case, a special type of tube mill having feed inlet openings at both ends of the mill and a central discharge compartment is especially applicable.

In the circuit drying tube mills, the drying gas and the moist material are fed at one end of the mill to a drying chamber having (or not having) a charge of grinding media therein. The gas and material proceed from the drying chamber to a coarse grinding chamber from which they pass to the central discharge compartment and out of the mill to a separator. Oversized material may be returned to the mill (preferably to the opposite end of the mill) and into a fine grinding chamber. Fine grinding takes place in the fine grinding chamber (or chambers) and the resulting fine product is likewise discharged to the central discharge compartment of the mill. Drying gas may also be introduced into the fine grinding section of the mill for additional drying of the material.

The prior art sieving diaphragms were constructed and positioned to form end walls of the discharge compartment so as to retain the grinding media and/or material within its respective chamber. When the discharge compartment is so bounded, it becomes difficult to achieve sufficient drying of the moist material because the sieve openings in the sieving diaphragms restrict the passage of the hot gas through the chamber. This limits the amount of gas which can be pressed or drawn through the mill and makes it difficult to have a sufficient amount of the gas pass to the discharge compartment at an acceptable pressure loss. Further, since the sieving diaphragms are circular and segmented, the sieves necessarily include stiffening rings and radial bars. These rings and bars restrict the sieving area of the sieving diaphragms and thereby restrict the passage of the hot gas therethrough.

I have invented a tube mill which avoids these drawbacks and provides an improved approach for drying and grinding granular raw material such as cement clinker.

SUMMARY OF THE INVENTION

A tube mill is disclosed which comprises at least one grinding chamber having a material inlet end portion and a material outlet end portion with means for introducing hot gases therein. The tube mill further comprises sieving means communicating with the material outlet end portion of said grinding chamber and extending generally away from the material outlet end portion, said sieving means being generally tapered in the direction of material flow through the associated grinding chamber and having a sieving area greater than the area of the material outlet end portion of the associated grinding chamber proper.

In one embodiment, a tube mill for grinding granular material is disclosed and comprises at least two grinding chambers, each chamber having a material inlet end portion and a material outlet end portion, at least the first grinding chamber having means for introducing hot gases therein. A discharge compartment communicates with the material outlet end portion of at least one of the grinding chambers, said discharge compartment defining at least one opening for passage of material therefrom. At least one sieving drum communicates with the material outlet end portion of at least one of said grinding chambers and extends generally away from said material outlet end portion and into the discharge compartment. The sieve drum is generally tapered in the direction of flow of material through the associated grinding chamber and provides sieving area greater than the area of the material outlet end portion of the associated grinding chamber.

In a further embodiment, a tube mill is disclosed which comprises a rotary shell including at least two grinding chambers which are respectively positioned on each side of a discharge compartment and defines outlet openings about its periphery. The tube mill also comprises means associated with each grinding chamber for introducing at least one of material to be ground and hot gases for grinding the material. A sieving diaphragm is associated with each grinding chamber and communicates said grinding chamber with the discharge compartment so as to form, respectively, end walls of said discharge compartment. At least a first of said sieving diaphragms defines a generally central opening. A generally frustoconical sieve drum is attached to said first sieving diaphragm for rotation therewith and each sieve drum associated with a grinding chamber is tapered generally in the direction of the other sieving diaphragm so as to form a portion of at least one end wall of said discharge compartment.

The frustoconical sieve drum is thus united with and forms a part of the sieving diaphragm. The effective sieving area of the diaphragm thereby is substantially increased without altering the construction of the mill proper since the conical sieve drums are arranged inside the discharge compartment. The larger sieving area of the sieving diaphragm and sieve drum permits an increased flow of gas through the mill without otherwise necessitating any other alterations in the drying and grinding process.

Drying gas for grinding mill drying processes is usually, as described above, waste gas from a burning process and therefore must be accepted at its available temperature. With the present invention, it is possible to obtain an improved drying by this available gas compared with the drying performed in the tube mills of the prior art. It may even be possible to utilize a drying gas having a temperature lower than the temperature considered necessary for the gas used in the conventional drying and grinding plants and which was previously considered as an unusable waste gas constituting an unavoidable heat loss.

It is a further advantage that in a construction according to the invention, the frustoconical sieve drum improves the stability of the sieving diaphragm. The sieving diaphragms bounding the discharge compartment may, by means of the sieve drum (or sieve drums), be joined together to form a solid construction in which the conventional space-consuming radial stiffening bars may be reduced in number —or even eliminated— thereby permitting an increased number of sieve openings in the sieving diaphragms which further increases the total passage area for the drying gas and the material.

Thus, in a preferred construction, each sieving diaphragm is formed with a frustoconical sieving drum, the drums being united at their narrower ends and the interiors of the two drums being separated at their united ends by a central circular solid plate or by a central circular sieve plate through which the coarse grinding chamber communicates with the fine grinding chamber. This latter construction permits a direct equalization of the pressures in the grinding chambers and, in case of need, a direct ventilation of the fine grinding chamber by a portion of the spent drying gases passed through the sieve plate. Moreover, the construction ensures a stiffening and stabilizing of both sieving diaphragms without requiring stay bolts or other fixing devices which could obstruct the passage of gas and material through the discharge compartment.

At least one of the sieve drums may be surrounded by a frustoconical ring which is united with its respective sieving diaphragm. The ring tapers in such a manner that material passing through the respective sieve drum wall is directed away from the respective sieving diaphragm. The frustoconical ring thus ensures that material passing through the sieve drum is suspended in the hot gas passing through the discharge compartment.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
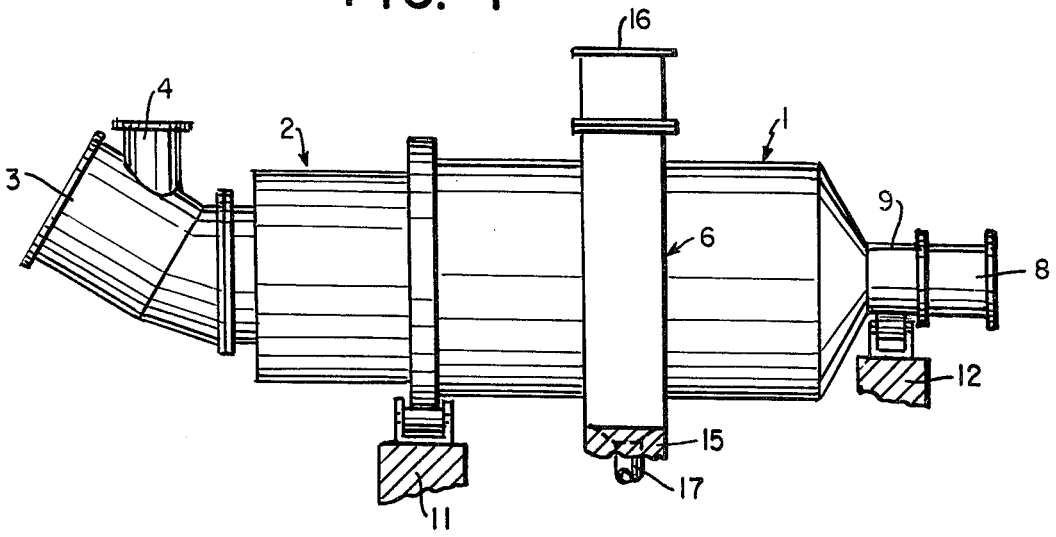
FIG. 1 is a side view of a tube mill constructed according to the invention.
Figure 2:
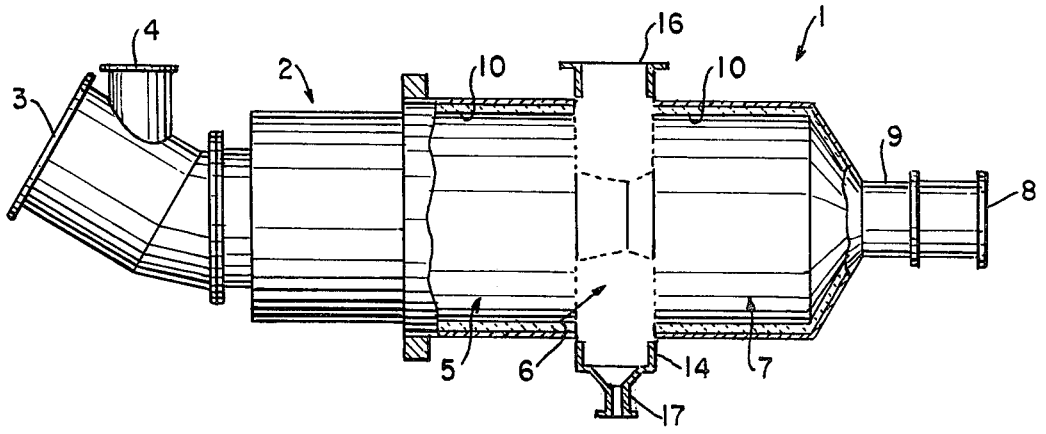
FIG. 2 is a side view, partially in cross-section, of the tube mill shown in FIG. 1.

Referring to FIGS. 1 and 2, there is illustrated a tube mill 1 having a drying chamber 2 with inlets 3 and 4 for introducing drying gas and moist material, respectively. The tube mill proper is divided into a drying and coarse grinding chamber 5, a discharge compartment 6 and a fine grinding chamber 7 with an inlet 8 and a hollow trunnion 9. The grinding chambers 5 and 7 are each provided with a wear-resistant lining 10. The mill is rotatable on bearings supported by foundations 11 and 12.

Figure 3:
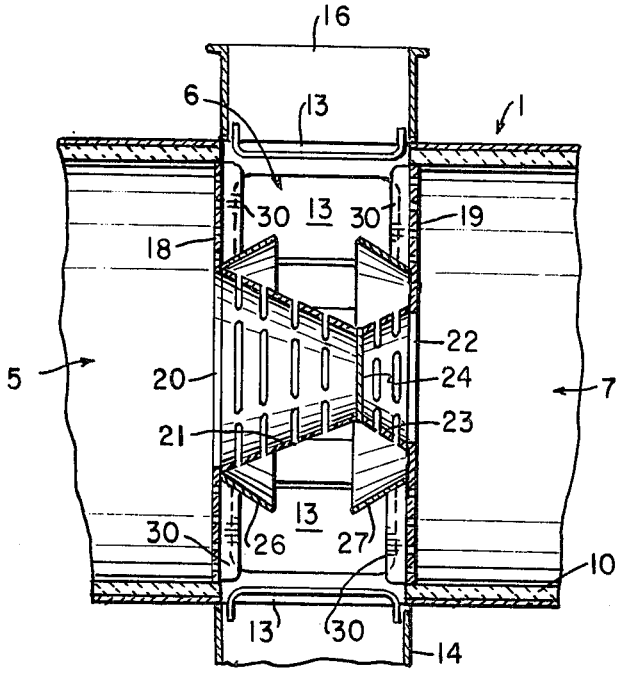
FIG. 3 is a detailed cross-sectional view of the discharge chamber of the tube mill of FIG. 1.
Figure 4:
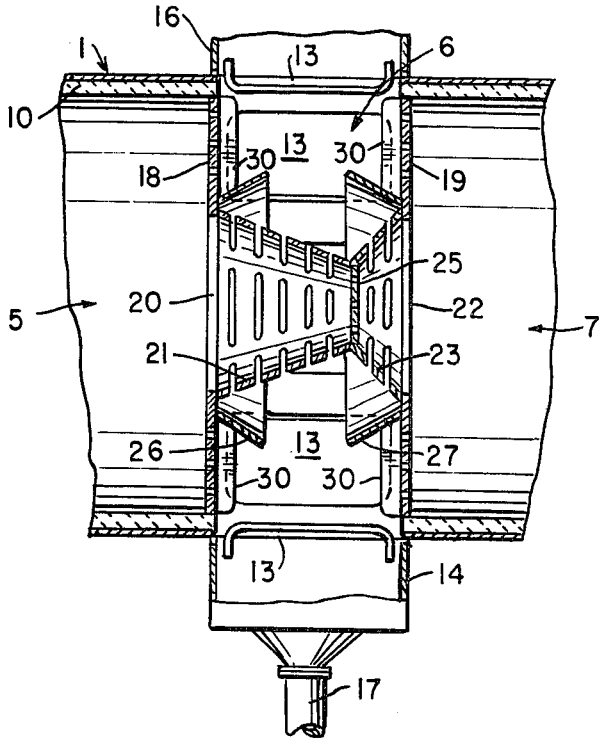
FIG. 4 is a detailed cross-sectional view of an alternate embodiment of the discharge chamber of the tube mill of FIG. 1.

FIGS. 3 and 4 show in detail the discharge compartment 6 of the tube mill 1. The part of the mill 1 containing the discharge compartment 6 has peripheral openings 13 through the mill shell. Further, the discharge compartment 6 is surrounded by a stationary casing 14 mounted on a support 15. The stationary casing 14 has a top opening 16 for the discharge of gas and entrained material and a bottom opening 17 for the discharge of the material not entrained by the hot gas.

The discharge compartment 6 has end walls in the form of sieving diaphragms 18 and 19 separating the compartment from the coarse and the fine grinding chambers 5 and 7, respectively. The sieving diaphragm 18 has a central opening 20 covered by a frustoconical sieve drum 21, and the sieving diaphragm 19 likewise has a central opening 22 covered by another frustoconical sieve drum 23. In FIG. 3, the sieve drums 21 and 23 are mounted together by a solid plate 24. Alternately, the sieve drums 21 and 23 are mounted together by a sieve plate 25 as shown in FIG. 4. The sieve drums 21 and 23 are also surrounded by frustoconical rings 26 and 27, respectively.

Referring further to all the drawings, material enters the coarse grinding chamber 5 at inlet 4 and a portion of the material mixes with drying air entering the coarse grinding chamber at inlet 3. Oversized material which had previously passed through the tube mill, passes from inlet 8, through trunnion 9 and into the fine grinding chamber 7. The material and gas pass from the grinding chambers 5 and 7, through the sieving diaphragms 18 and 19, respectively, and into the discharge compartment 6. Due to the configuration of the sieve drums 21 and 23, their effective screening area is greater than the screening area of the conventional plate-type sieving diaphragms. The united configuration of sieve drums 21 and 23 also improves the stabilization of the construction of the entire tube mill without appreciably hindering the passage of material through the discharge compartment 6.

The material passing through the sieve diaphragms 21 and 23, which was not entrained in the hot gas, is directed away from the sieving surfaces of the sieve drums 21 and 23 by the frustoconical rings 26 and 27 and to the bottom of the casing 14. From there, it is removed by conventional means such as a screw conveyor communicating with the outlet 17 or a jet of gas sweeping the bottom of the casing 14.

In a preferred embodiment, the discharge compartment is provided with lifting means 30 located on the sides of the sieving diaphragms that face the interior of the discharge compartment 6. The lifting means 30 (for example, radial vanes, stiffening ribs or bars) lift and discharge the material into the hot gas so that most of the material is entrained in the gas and carried with the gas from the mill through the opening 16 in the casing 14. The lifting means 30 serves to reinforce the sieving diaphragms 18 and 19.

I claim:

1. A tube mill for grinding and drying granular material which comprises:

(a) an elongated shell having a first chamber for drying and grinding material and a second chamber for at least grinding material, said grinding chambers having a material inlet end portion and a material outlet end portion, at least the first chamber having means for introducing hot gases to the first chamber, said chambers being rotatable on the same axis of rotation and their material outlet end portions communicate;

(b) a discharge compartment communicating the material outlet end portions of each chamber, said discharge compartment having means for discharging hot gases and material therefrom;

(c) a stationary casing surrounding the discharge chamber and adapted to receive gas and material exiting the discharge compartment;

(d) a first sieving diaphragm communicating with the material outlet end portion of the first chamber and defining a generally central opening therethrough;

(e) a second sieving diaphragm communicating with the material outlet end portion of the second chamber and defining a generally central opening therethrough;

(f) a first frustoconical sieve drum positioned within the discharge compartment and configured so that its cross-section generally decreases in the direction of flow of material through the first chamber, the interior of the sieve drum communicating with the first sieving diaphragm such that material passes from the first grinding chamber thereto;

(g) a second frustoconical sieve drum positioned within the discharge compartment and configured so that its cross-section generally descreases in the direction of flow of the material through the second chamber, the interior of the second sieve drum communicating with the second sieving diaphragm such that material passes from the second grinding chamber thereto, the narrow end portions of the first and second sieve drums abutting the opposed sides of at least one of a solid plate and a sieve plate; and (h) at least one frustoconical ring located and positioned adjacent at least one of said sieving diaphragms and surrounding one of the sieve drums so that material passing from said sieve drum is directed away from the associated sieving diaphragm.

2. A tube mill which comprises:

(a) a rotary shell including at least two grinding chambers respectively positioned on each side of a discharge compartment defining outlet openings about its periphery, each grinding chamber having a material inlet end portion and a material outlet end portion, and at least the first of said grinding chambers having means for introducing hot gases therein;

(b) a sieving diaphragm associated with each grinding chamber and communicating the material outlet end portion of the associated grinding chamber with said discharge compartment so as to form respectively end walls of said discharge compartment, each sieving diaphragm defining a generally central opening therein;

(c) a first generally frustoconical sieve drum attached to said first sieving diaphragm for rotation therewith, and being tapered generally in the direction of the other grinding chamber so as to form a portion of at least one end wall of said discharge compartment, the first sieve drum and its associated first sieving diaphragm having a combined sieving area greater than the area of the material outlet end portion of the associated grinding chamber;

(d) a second generally frustoconical sieve drum attached to the other sieving diaphragm for rotation therewith, said second sieve drum being tapered generally in the direction of the other grinding chamber so as to form a portion of at least one end wall of said discharge compartment, said second sieve drum and its associated sieving diaphragm having a combined sieving area greater than the area of the material outlet end portion of the associated grinding chamber;

(e) means communicating with the narrow ends of each sieve drum for at least retarding the flow of material from one of said sieve drums to the other; and (f) a stationary casing communicating with the discharge compartment and adapted to receive material and hot gases from the discharge chamber.

3. The tube mill according to claim 2, wherein the material retarding means comprises a plate-like member.

4. The tube mill according to claim 3 wherein the plate-like member is a solid plate.

5. The tube mill according to claim 4, which further comprises at least one frustoconical ring attached to at least one of said sieving diaphragms positioned so as to surround the associated sieve drum and direct the material passing through said sieve drum away from said sieving diaphragm.

6. The tube mill according to claim 5, which further comprises lifting means communicating with at least one of the sieving diaphragms, said lifting means being located and configured so as to lift and entrain material passing through the discharge chamber into the flow of gas passing through the discharge chamber.

7. The tube mill according to claim 2, wherein the material retarding means comprises a sieve plate.

8. The tube mill according to claim 7, which further comprises at least one frustoconical ring attached to at least one of said sieving diaphragms positioned so as to surround the associated sieve drum and direct the material passing through said sieve drum away from said sieving diaphragm.

9. The tube mill according to claim 8, which further comprises lifting means communicating with at least one of the sieving diaphragms, said lifting means being located and configured so as to lift and entrain material passing through the discharge chamber into the flow of gas passing through the discharge chamber.

* * * * *